US006379479B1

(12) United States Patent
Ohbayashi et al.

(10) Patent No.: US 6,379,479 B1
(45) **Date of Patent: *Apr. 30, 2002**

(54) STEEL MEMBER SURFACE TREATMENT METHOD

(75) Inventors: Kouji Ohbayashi; Michio Maruki; Takao Taniguchi; Yoshimi Watanabe, all of Anjo (JP)

(73) Assignee: Aisin AW Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/612,282

(22) Filed: Jul. 7, 2000

Related U.S. Application Data

(63) Continuation of application No. 08/949,407, filed on Oct. 14, 1997, now abandoned.

(30) Foreign Application Priority Data

Oct. 16, 1996 (JP) ..... H8-295716

(51) Int. Cl.[7] ..... C21D 1/09
(52) U.S. Cl. ..... 148/512; 148/565
(58) Field of Search ..... 148/512, 565

(56) References Cited

U.S. PATENT DOCUMENTS 5,961,751 A * 10/1999 Maruki ..... 148/565

FOREIGN PATENT DOCUMENTS

| | | | |
|---|---|---|---|
| JP | 53-43026 | | 4/1978 |
| JP | 01-222019 | * | 9/1989 |
| RU | 2004613 | | 12/1993 |

OTHER PUBLICATIONS

Chang et al. Surface Hardening of Carbon Steel Using an 1.0–2.5 MeV electron accelerator in the atmosphere, 1993.

Bello et al. Laser Treatment of an X40Cr13 Martensitic Stainless Steel (and Translation), Mar. 1991.

* cited by examiner

*Primary Examiner*—George Wyszomierski
(74) *Attorney, Agent, or Firm*—Lorusso & Loud

(57) ABSTRACT

In a steel member surface treatment method, only a surface layer portion of the steel member is heated to its melting point or higher to form a melt, by high density energy-beam irradiation. Subsequently, the melted portion is rapidly cooled to a martensitic transformation region, to form a martensitic structure. The temperature increasing rate in irradiation of the surface layer of the steel member is preferably 7500° C./second or greater. Thereby, thermal strain and quenching failure are reduced even if the steel member is a thin plate component and a high production efficiency can be achieved.

20 Claims, 13 Drawing Sheets

STEEL MEMBER SURFACE TREATMENT METHOD

CROSS-REFERENCE TO RELATED APPLICATION

This application is a continuation of U.S. patent application Ser. No. 08/949,407 filed Oct. 14, 1997 and now abandoned.

The entire disclosure of Japanese Patent Application No. Hei 8-295716 filed on Oct. 16, 1996 including the specification, drawings and abstract is incorporated herein by reference.

BACKGROUND OF THE INVENTION

1. Field of the Invention

The present Invention relates to a steel member surface treatment wherein a hardened layer is formed at the surface of the steel member while producing minimal thermal strain.

2. Description of the Related Art

In steel members having surface portions in sliding contact with other members, various measures have conventionally been taken to improve the abrasion resistance of the sliding contact surface portions.

A hard steel provides abrasion resistance but, since forming processes are difficult with hard steel, hard steel cannot be suitably used for a member that requires much forming, for example, a lockup piston or the like.

Accordingly, for steel members requiring considerable forming, typically, only a surface layer is quenched for hardening to improve abrasion resistance. Such a surface hardening method may be surface quenching by high density energy beam irradiation, such as high frequency quenching, electron beam (EB) quenching, laser quenching and the like.

In such quenching methods, a surface to be treated is first heated by high frequency heating or high density energy beam irradiation, and a surface layer portion is maintained at an austenitizing temperature (quenching temperature). When the surface layer is austenitized, the heating is stopped. Then, the steel member is rapidly cooled by, for example, allowing it to self-cool in the ambient atmosphere, so that austenite in the surface layer portion transforms into martensite, thereby forming a hardened layer.

However, in the above-described conventional surface quenching method, since uniform austenite is obtained by heating, it is necessary to maintain a surface layer at a quenching temperature for at least the length of time needed for austenitic transformation. This problem will here be explained with reference to the T-T-A curve diagram shown in FIG. 1. The diagram shows an $A_3$ transformation starting line (austeriitic transformation starting line) and an $A_3$ transformation ending line (austenitic transformation ending line), with the abscissa indicating time (logarithmic scale), and the ordinate indicating temperatures In the diagram, temperature of a steel member surface undergoing a conventional surface quenching method is indicated by a solid line C1. As can be seen from: the diagram of FIG. 1, after heating is started, some time must elapse before a normal structure (ferrite-pearlite structure) will completely transform into austenite in the conventional method.

Therefore, if the member being treated is, for example, a thin plate component, a large portion of the treated member undergoes temperature increase due to heat conduction during austenitic transformation, creating various problems. For example, thermal strain may alter the shape of the member (loss of precision of shape), or self release of heat (spontaneous cooling) may be insufficient to provide proper quenching.

Furthermore, since the conventional method requires maintaining a high temperature for a period of time equal to or longer than the austenitic transformation time as described above, there are also problems of a lengthy heat treatment and low productivity.

SUMMARY OF THE INVENTION

The present invention has as its objective overcoming the above-described problems with the conventional treatments. It is intended to provide a steel member surface treatment method which eliminates thermal strain and quenching failure, even if the member under treatment is a thin plate component, and to provide a highly efficient process.

Accordingly, the present invention provides a surface treatment of steel wherein only a surface layer of the steel member is heated to its melting point or higher by high density energy beam irradiation, and then the melted portion is rapidly cooled to a temperature within the martensitic transformation region so as to form a martensitic structure.

Thus, in the present invention, only a surface layer of a steel member is heated to form a melt and the melted portion is converted into a martensitic structure. That is, instead of waiting for completion of austenitic transformation while maintaining a bulk piece at a temperature within an austenitic transformation temperature region as in the conventional art, the melted portion is formed by actively heating a limited area on the surface of the piece at a rapid rate to a temperature equal to the melting point or higher, which temperature is also equal to or higher than the austenitic transformation temperature, to form a martensitic structure by transition from the austenitic structure.

The "high density energy beam" may be, for example, an electron beam, a laser beam, or other high density energy such as high frequency heating, although technically not a "beam". These are collectively referred to as "high density energy beams" in the description of the present invention which follows.

Steels which may be treated by the method of the present invention, include, for example, carbon steels such as S50C, S23C, S1OC and the like, alloy steels such as SNCM, SCR, SCM and the like, and tool steels such as SK, SKH, SKS and the like. The aforementioned melting point and martensitic transformation region are determined by the nature of the steel treated.

In the present invention, only a surface portion of a steel member is heated to its melting temperature or higher to form a melted portion by high density energy beam irradiation as described above. Since the thermal energy is provided by high density energy beam irradiation, it becomes possible to very rapidly form a melted portion. Furthermore, since the thermal energy is high density energy, it becomes possible to selectively melt only a surface layer of the steel member in a very short time.

The melted portion is then allowed to rapidly release heat and cool, by stopping the high density energy beam irradiation or by shifting the position of the beam. The melted portion rapidly cools because it is limited to a surface layer of the steel member as stated above. Because the interior of the steel member around the melted portion is at a temperature significantly lower than that of the melted portion, the melted portion rapidly releases heat and thus rapidly cools due to heat conduction to the surrounding portions of the steel member. It is also possible to utilize forced cooling, such as water cooling or the like, in addition to spontaneous heat release.

During the rapid cooling of the melted portion, the melted layer solidifies and immediately obtains an austenitic structure. The austenitic structure is subsequently cooled to a martensitic transformation region in a very short time.

Due to formation of a martensitic structure, the melted portion becomes very hard and forms an excellent hardened. surface.

Thus, the present invention first forms a melted portion only in a surface layer of a steel member in a very short period of time, and then martensitizes the melted portion in a very short period of time. Therefore, it becomes possible to obtain a sufficiently quench-hardened layer and to reduce the surface treatment time and, therefore, to improve productivity. Furthermore, since heat conduction to portions of the steel member surrounding the treated portion is low, temperature rise and thermal strain in the surrounding steel are lower than with the conventional prior art treatment.

The present invention provides a highly efficient surface hardening treatment, with reduced thermal strain and occurrence of quenching failure, even if the steel member is a thin plate component.

In addition, it is possible to provide a heat--treated portion as a smooth finished surface, without any waviness, by suitably selecting depth and width of the melted areas and the processing rate as described below.

It is preferable that the rate of temperature increase in the surface layer of the steel material be equal to or greater than 7500° C./second. If the temperature increase rate is less than 7500° C./second, problems occur related to increased heat conduction to the steel surrounding the treated portion and increased treatment time. The upper limit for the heating rate is preferably 500,000° C./second, in consideration of the practical limits of the apparatus used.

It is also preferred that the time between start of impingement with the high density energy beam and formation of the melted portion be within 0.2 second. If it exceeds 0.2 second, the heat conduction to the metal surrounding the treated portion increases, thereby causing problems of increased thermal strain, due to temperature increase in the surrounding metal, and failure of quenching due to insufficient self-release of heat. The lower limit is preferably 0.003 second, in consideration of the practical limits of the apparatus used.

It is preferable.that cooling to the martensitic transformation region from the melt be at a rate equal to or greater than 600° C./second. If the cooling rate is less than 600° C./second, there may be a failure of quenching, depending on the type of steel. The upper limit is preferably 1800° C./second, from the viewpoint of minimizing thermal strain.

It is preferred:that the melted portion have a depth such that waviness is not produced on the surface of the steel material. More specifically, it is preferred to adjust the output of a high density energy beam, irradiation duration and the like in accordance with the width of the melted portion, the processing speed and the like so that no waviness occurs on the steel member surface. It thereby becomes possible to obtain a steel member with excellent shape precision.

The melted portion may comprise a completely melted layer, i.e. in a completely melted state, and an incompletely melted layer contiguous to the completely melted layer. The incompletely melted layer is a layer that is hardened by quenching based on heat conduction from the completely melted layer, and the quenching depth thereof can be controlled in accordance with the temperature increasing rate. Therefore, a relatively large quenching depth can be obtained without deepening (thickening) the completely melted layer, thereby making it possible to prevent surface waviness.

The high density energy beam may be emitted from a single source of beam emission and divided for impingement upon a plurality of areas, for example, by using a deflecting lens or the like. Thus, a plurality of locations on the steel member can be simultaneously irradiated with high density energy beams, providing surface treatment of a plurality of areas in one processing step. In this manner, heat conduction to the metal surrounding the melted portion can be limited so that even if a plurality of adjacent locations are simultaneously treated, there is no thermal interference among the individual treated regions, and no undesirable tempering or annealing will occur in the treated regions.

It is preferable that the melted portion(s) be rapidly cooled by leaving it to cool by itself, i.e. spontaneous cooling. That is, the cooling is preferably accomplished by mere heat release from the melted portion to the interior and exterior of the steel member. Cooling in this manner provides a simplified operation, as compared with the case of forced cooling, such as water cooling.

It is preferable that the heat capacity of the entire steel member be at least 4 times as large as the heat capacity of the melted portion to provide rapid heat release from the melted portion to the interior of the steel member.

It is also preferred that the depth of the melted portion be at most b ¼ of the thickness of the steel member to provide rapid heat release to the unmelted, surrounding metal.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein:

FIG. 2 shows schematic illustrations of high density energy beam irradiation in the first embodiment, wherein FIG. 2(A) is a side view and FIG. 2(B) is a plan view;

Figure 8:
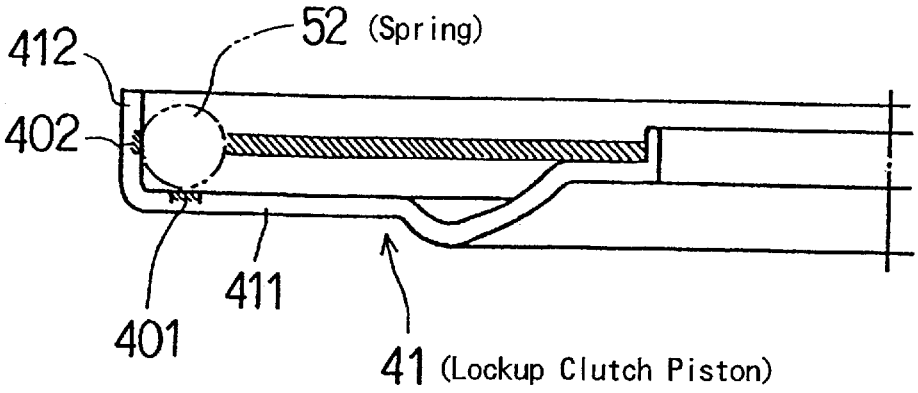
Figure 9:
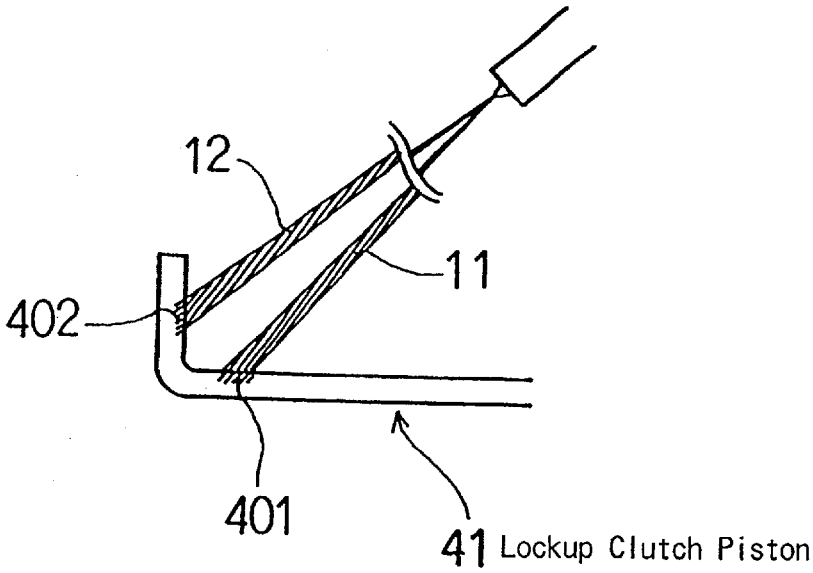
Figure 10:
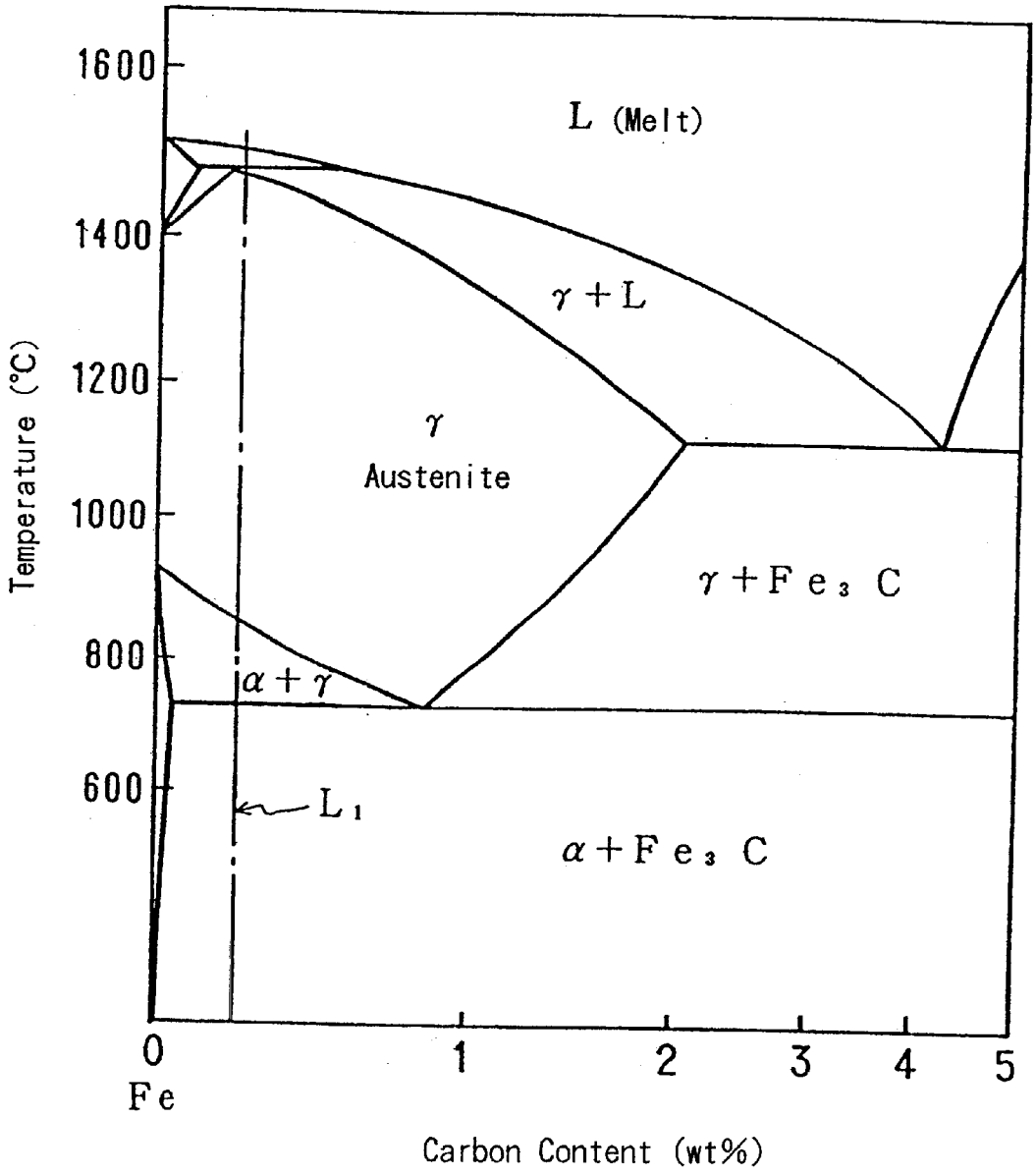
Figure 11:
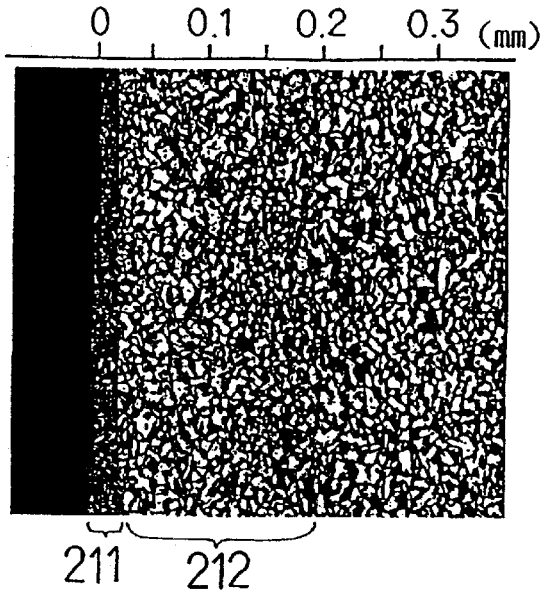
Figure 12:
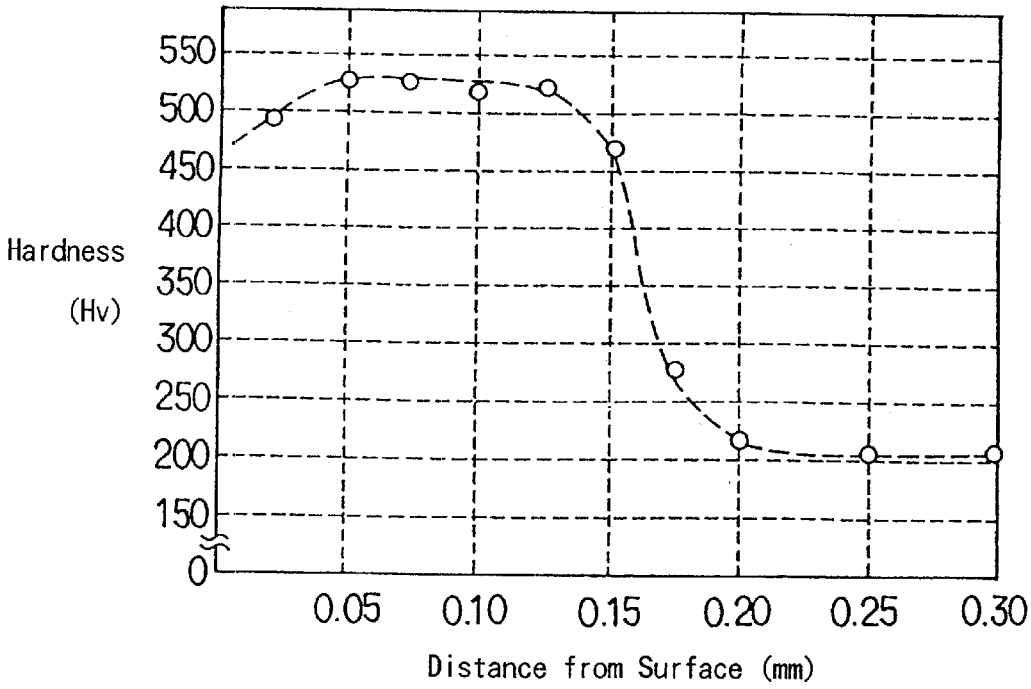
Figure 13:
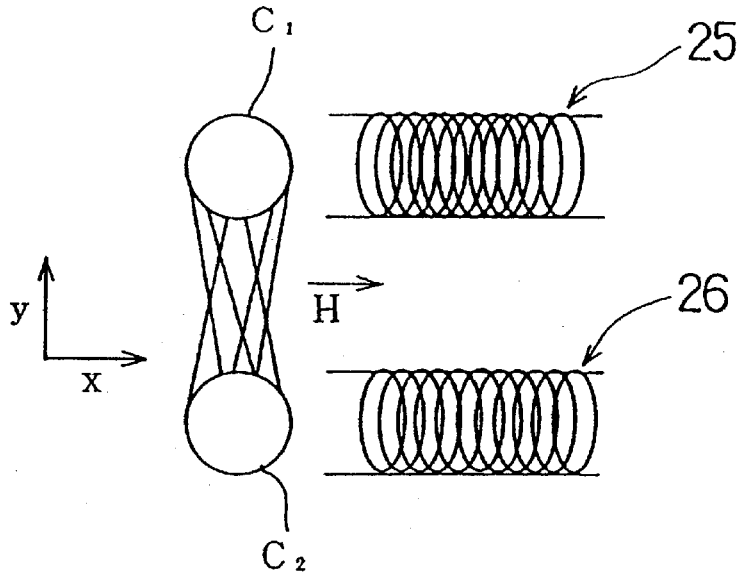
Figure 14:
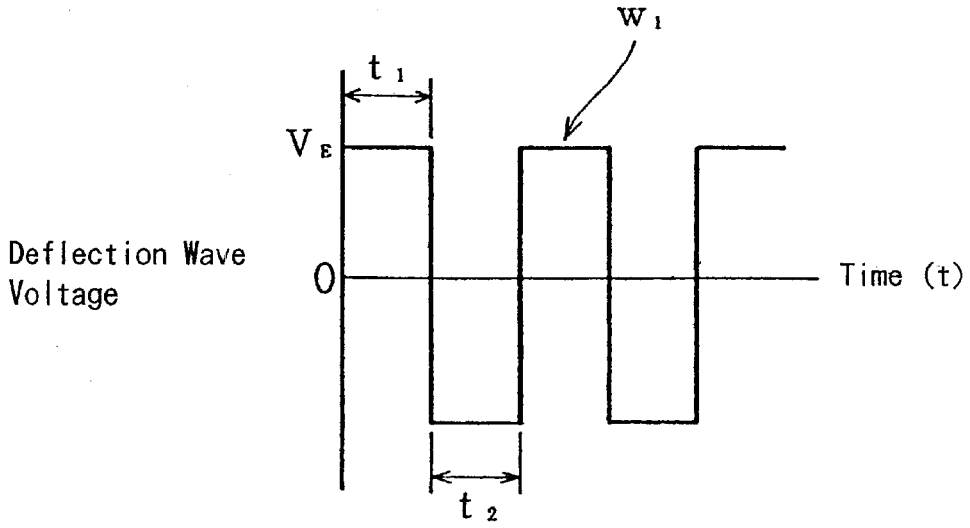
Figure 15:
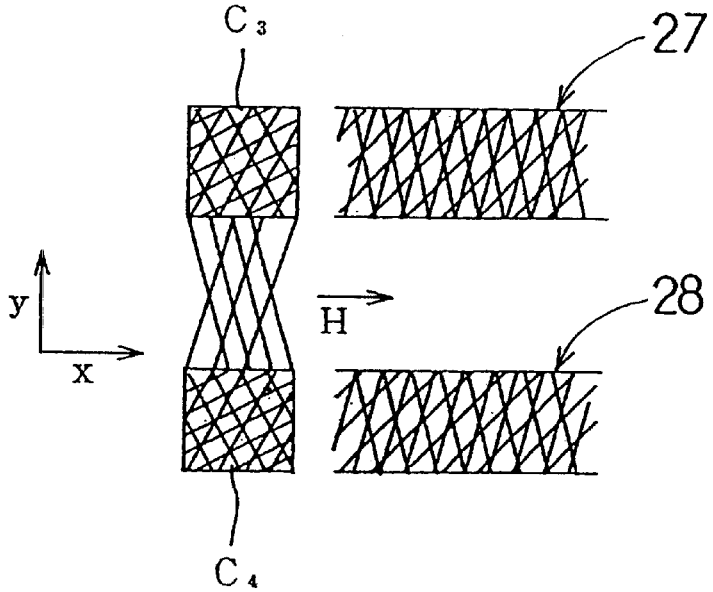
Figure 16:
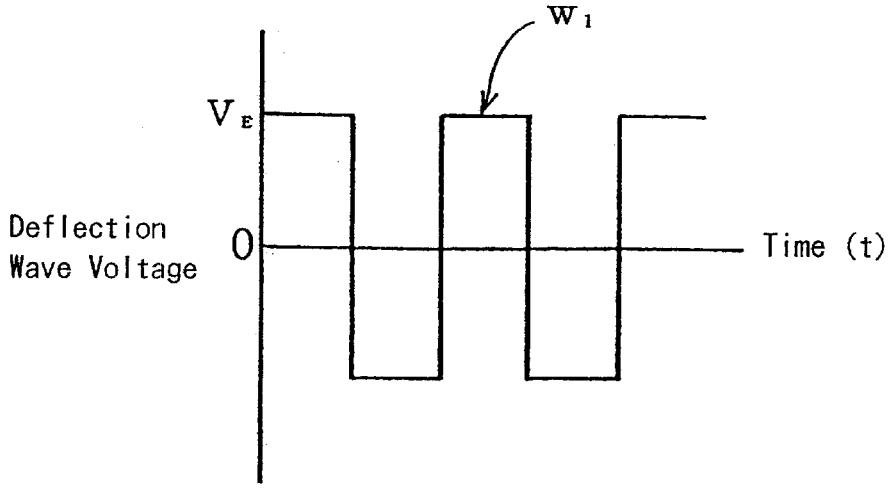
Figure 17:
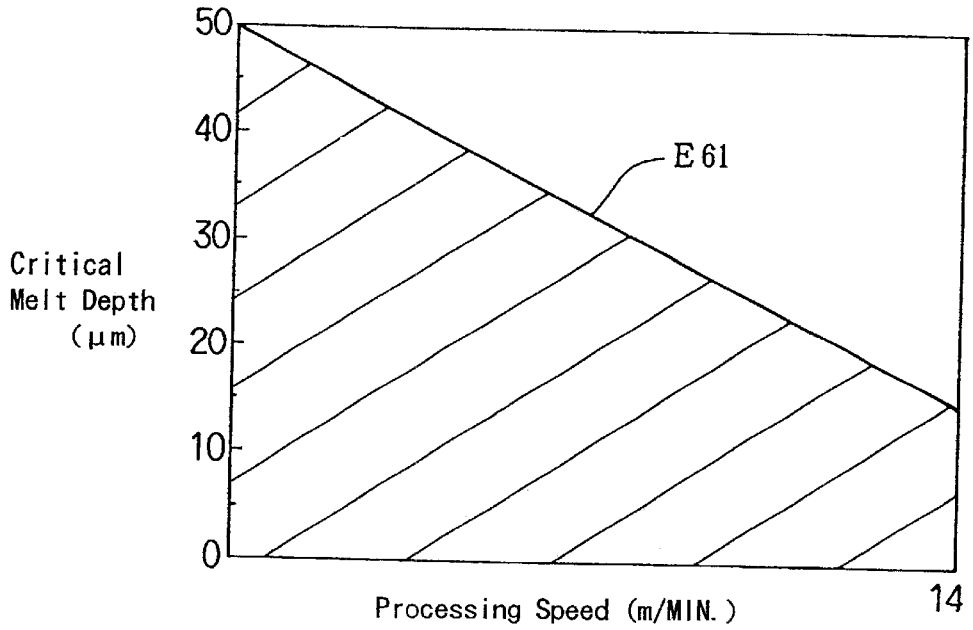
Figure 18:
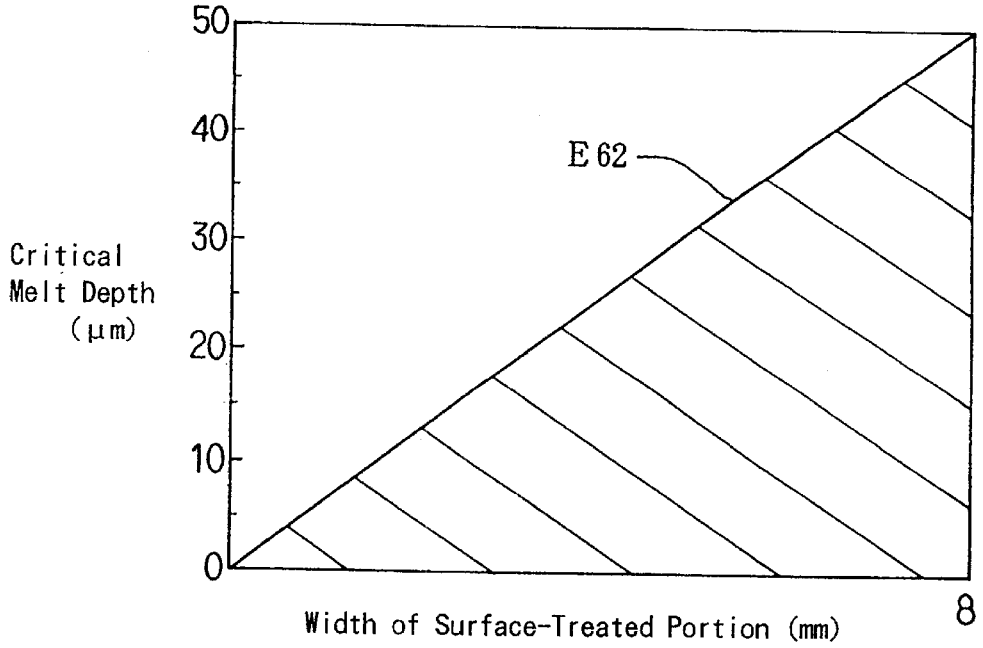

FIG . 8 illustrates surface-treated portions of a lockup clutch piston;

FIG. 9 illustrates.use of high density energy beam irradiation to form the surface-treated portions shown in FIG. 8;

FIG. 10 is an iron-carbon phase equilibrium diagram;

FIG. 11 is a photograph (magnification 200×) showing crystal structure on a section of a surface-treated portion obtained with the apparatus of the third embodiment;

FIG. 12 is a graph of hardness versus distance from surface obtained for a treated area of a steel member produced by the apparatus of the third embodiment;

FIG. 13 illustrates loci of electron beam irradiation with the apparatus of the third embodiment;

FIG. 14 is a diagram showing an example of an electron beam deflection waveform produced by the apparatus of the third embodiment;

FIG. 15 is illustrates another example of loci of electron beam irradiation in accordance with the present invention;

FIG. 16 is a diagram showing an example of an electron beam deflection waveform in accordance with the present invention;

FIG. 17 is a graph of the relationship between the processing speed and the waviness critical melt depth in the present invention; and FIG. 18 is a graph of the relationship between the surface-treated portion width and the waviness critical melt depth in the present invention.

DETAILED DESCRIPTION OF PREFERRED EMBODIMENTS

Preferred embodiments of the present invention will now be described in detail hereinafter with reference to the accompanying drawings.

Embodiment 1

A first embodiment of the steel member surface treatment method of the present invention will be described with reference to FIGS. 1 and 2.

Figure 1:
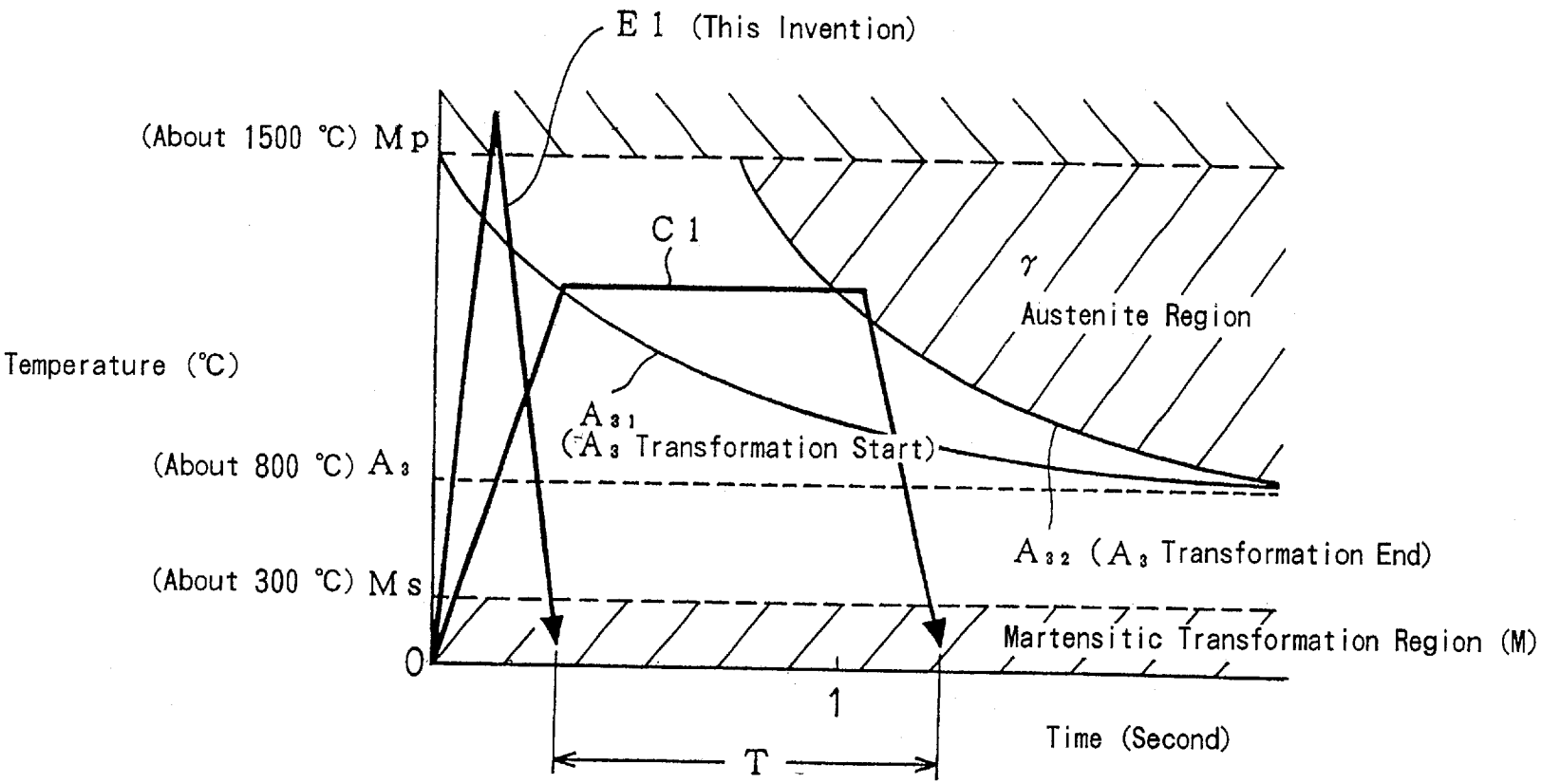
FIG. 1 is a T-T-A phase diagram illustrating phase changes in the treatment according to a first embodiment.
Figure 2:
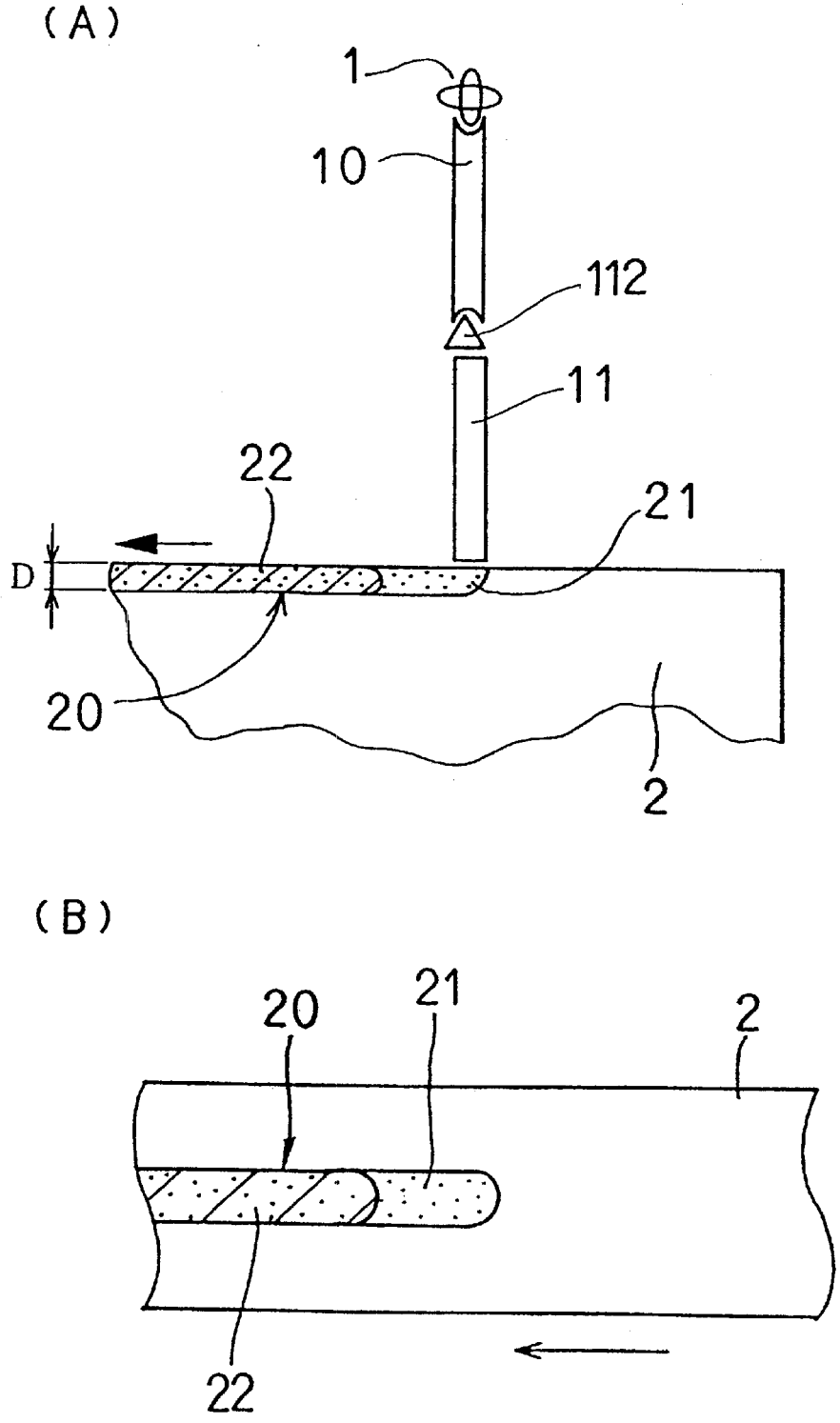

In this embodiment, as shown in FIGS. 2(A) and 2(B), a steel member 2 to be treated, is subjected to high density energy beam irradiation to heat only a surface layer of the steel member 2 to its melting point Mp or higher to form a melted portion 21 as indicated by a solid line E1 in FIG. 1. The melted portion 21 is subsequently rapidly cooled to a martensitic transformation region (M) to form a martensitic structure 22.

The diagram of FIG. 1 is a T-T-A phase diagram wherein the abscissa indicates time (logarithmic scale) and the ordinate indicates temperature (° C.). In the diagram, a curve $A_{31}$ is an $A_3$ transformation starting line and the $A_3$ transformation ending line is a curve $A_{32}$. The surface treatment method according to the present invention is indicated by the solid line E1, and a conventional EB quenching method is indicated, for comparison, by a solid line C1. Martensitic transformation can be accomplished by cooling a steel material to a temperature not exceeding the Ms point of the steel material, at a cooling rate equal to or greater than the critical cooling rate. In FIG. 1, therefore, the region below the Ms point is shown as a martensitic transformation region (M).

In FIG. 1, the time difference T between the processing time in this embodiment and the processing time using the conventional method is a reduction in the heat processing time achieved by the present invention.

In the case of the conventional EB quenching C1, it is necessary to achieve the austenitic transformation temperature in the treated portion, and to maintain that temperature until the transformation end point. Therefore, the overall processing time is longer than that of this embodiment of the present invention.

On the other hand, in this embodiment, a surface layer area of the steel member 2, forming melt 21 as shown in FIGS. 2(A) and 2(B), is heated at a very high rate of temperature increase, i.e. 7500° C./second or greater, thereby quickly forming a melt 21 having a temperature equal to or higher than the melting point Mp. In this case, the time between start of the high density energy beam irradiation and formation of the melt 21 is a very short time of 0.2 second. Adjustment is made so that the depth of the melted portion will become at most ¼ of the thickness of the steel member 2. This adjustment is to the high density energy beam output and/or irradiation pattern.

Next, the melt 21 is cooled at a very fast cooling rate of 600° C./second or greater, immediately after the melted portion 21 has been formed. The melted portion 21 thereby immediately solidifies and temporarily forms a uniform austenitic structure. As the cooling progresses, the melted portion 21 cools to within the martensitic region and thereby forms a martensitic structure 22.

Surface treatment in this embodiment is performed by partially irradiating a surface area 20 of the steel member 2 with a high density energy beam 11 as shown in FIGS. 2(A) and 2(B). That is, as shown in FIGS. 2(A) and 2(B), a high density energy beam 10 is emitted from a high density energy beam emission source 1, and an optimal irradiation pattern is provided by a deflecting lens 112, with which beam the steel member 2 is irradiated.

The steel member 2 is moved at a constant rate in the direction indicated by the arrow in FIGS. 2(A) and 2(B). The surface area 20 is rapidly heated and turned into a melt 21 by irradiation with the high density energy beam 11. As the steel member 2 moves, the melt 21 irradiated with the high density energy beam 11 cools due to self release of heat. Thus, a surface portion having the martensitic structure 22 and a high hardness is continuously formed in the steel member 2.

In this manner, this embodiment rapidly heats only a surface layer of the steel member 2 to a melted state and, immediately after that, rapidly cools it. Therefore, heat conduction to portions of the steel member 2 other than the surface-treated portion 20, is small, so that thermal strain can be reduced and self release of heat can be reliably achieved.

Since the melted portion 21 is formed only at the surface to a depth that is at most ¼ of the thickness of the steel member 2, it cools by self release of heat at a cooling rate of 600° C./second or greater. Therefore, a cooling rate sufficiently exceeding the critical cooling rate for martensitic transformation can be obtained, so that there is no failure of quenching.

Furthermore, this embodiment is able to considerably reduce the processing time as described above, compared with the conventional art, thereby providing an improvement in production efficiency.

Embodiment 2

Figure 3:
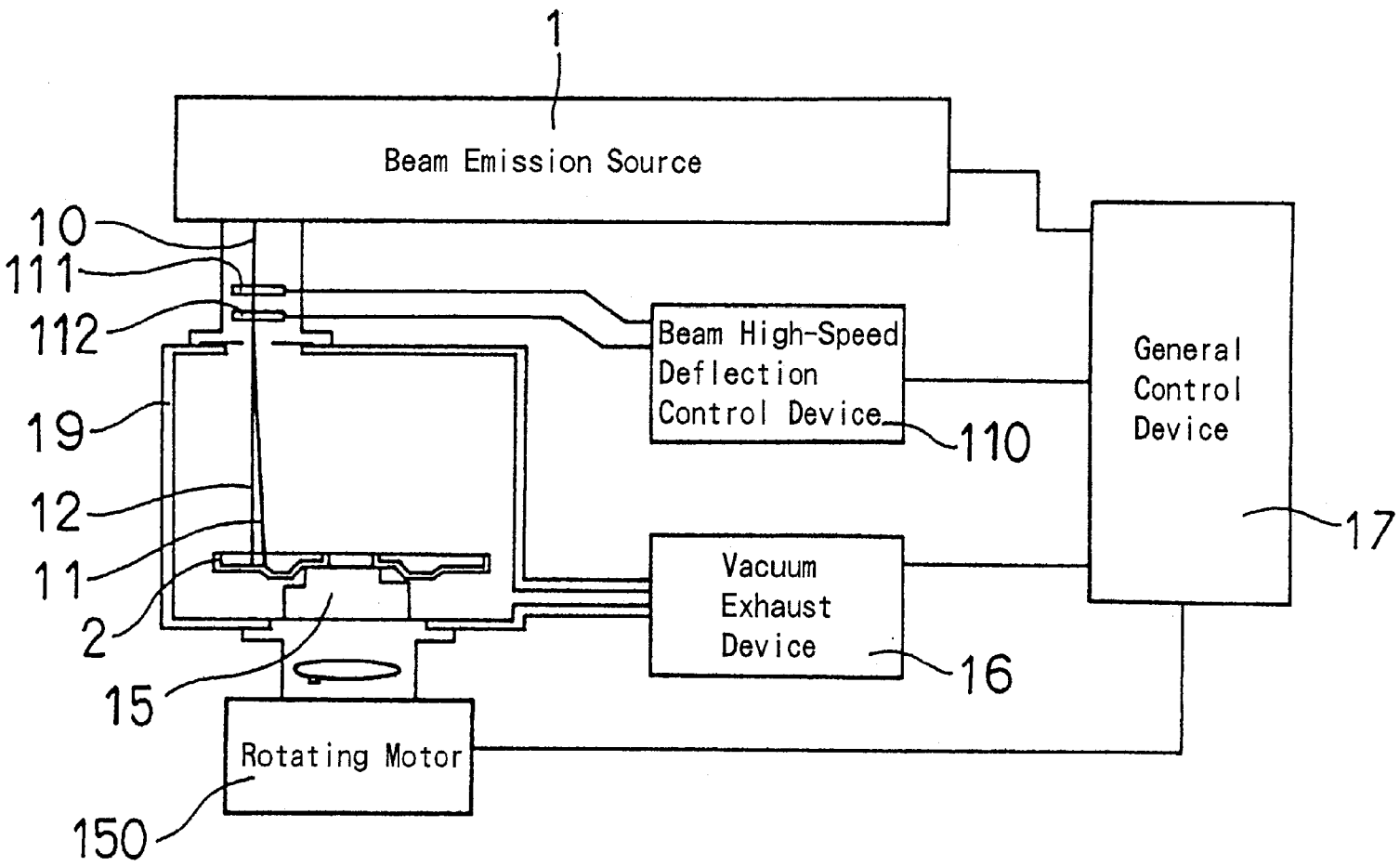
FIG. 3 is a block diagram of a heat treatment apparatus according to a second embodiment.
Figure 4:
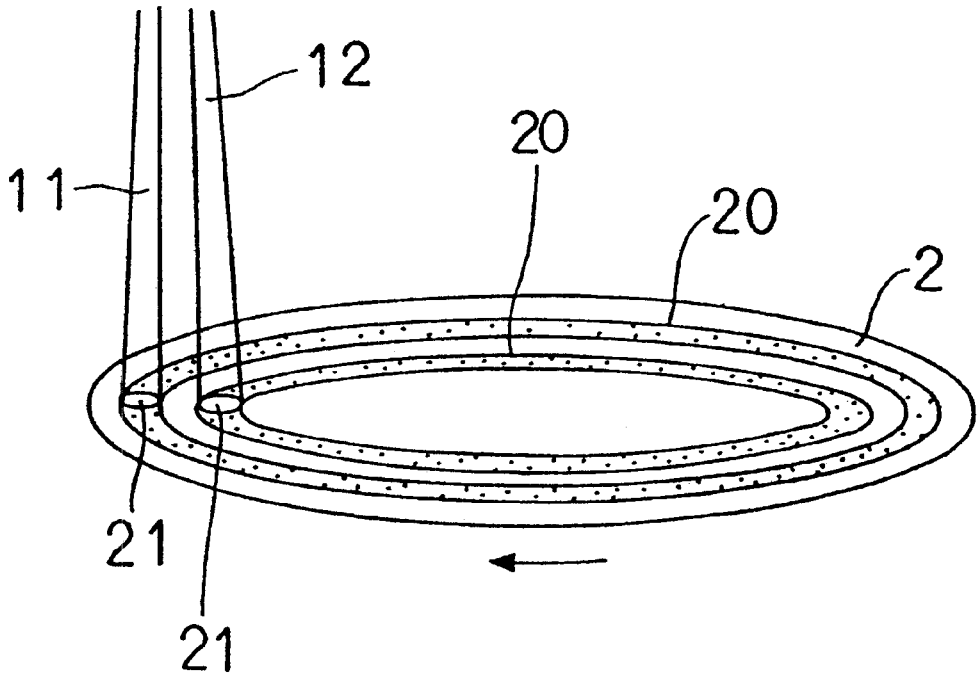
FIG. 4 is a diagram which illustrates high density energy beam irradiation using the apparatus of the second embodiment.

As shown in FIGS. 3 and 4, this embodiment provides a heat treatment apparatus and method wherein the steel member 2 is rotated and two ring-like surface treated portions 20 (FIG. 4) are continuously irradiated with high density energy beams 11, 12.

The steel member 2 to be treated in this embodiment, has, for example, a dish-like shape (see FIG. 3 and FIG. 6), as in a lockup clutch piston, which is a component of a torque converter as described below. The two ring-like surface treated portions 20 FIG. 4) are treated in one operation (FIG. 4).

The heat treatment apparatus has, as shown in FIG. 3, a processing chamber 19 into which the steel member 2 is placed, a beam emission source 1 for emitting the high density energy beams 11, 12 into the processing chamber 19, and a focusing lens 111 and a deflecting lens 112 for controlling the irradiation pattern of the high density energy beam 10 from the beam emission source 1.

The apparatus also has a vacuum device 16 for reducing pressure in the processing chamber 19, and a high-speed deflection control device 110 for controlling the focusing lens 111 and the deflecting lens 112. By controlling the focusing lens 111 and the deflecting lens 112, distribution of the high density energy beams 11, 12, which irradiate the steel member 2, and their output and irradiation pattern are adjusted. Overall control is provided by a general control device 17. Further, a motor 150 for rotating placement table 15 holding the steel member 2 is provided below the processing chamber 19.

To perform surface treatment using the heat treatment apparatus of this second embodiment, the motor 150 is first driven to rotate the steel member 2 as indicated by the arrow in FIG. 4. In addition, a vacuum is established in the processing chamber 19 by the vacuum device 16.

Then, irradiation with the two high density energy beams 11, 12 is simultaneously performed on the steel member 2 as shown in FIG. 3 and FIG. 4. The high density energy beams 11, 12 move relative to the steel member 2 at a constant rate by rotation of the steel member 2.

The portions irradiated with the high density energy beams 11, 12 as shown in FIG. 4 are converted to melted portions 21 and immediately form martensitic structure. Thus the two ring-like surface-treated portions 20 become hardened layers.

In this case, it is possible to provide the steel member 2 with two surface treated portions 20, with a very high efficiency. Further, the advantages substantially as described for Embodiment 1 can be achieved.

Figure 5:
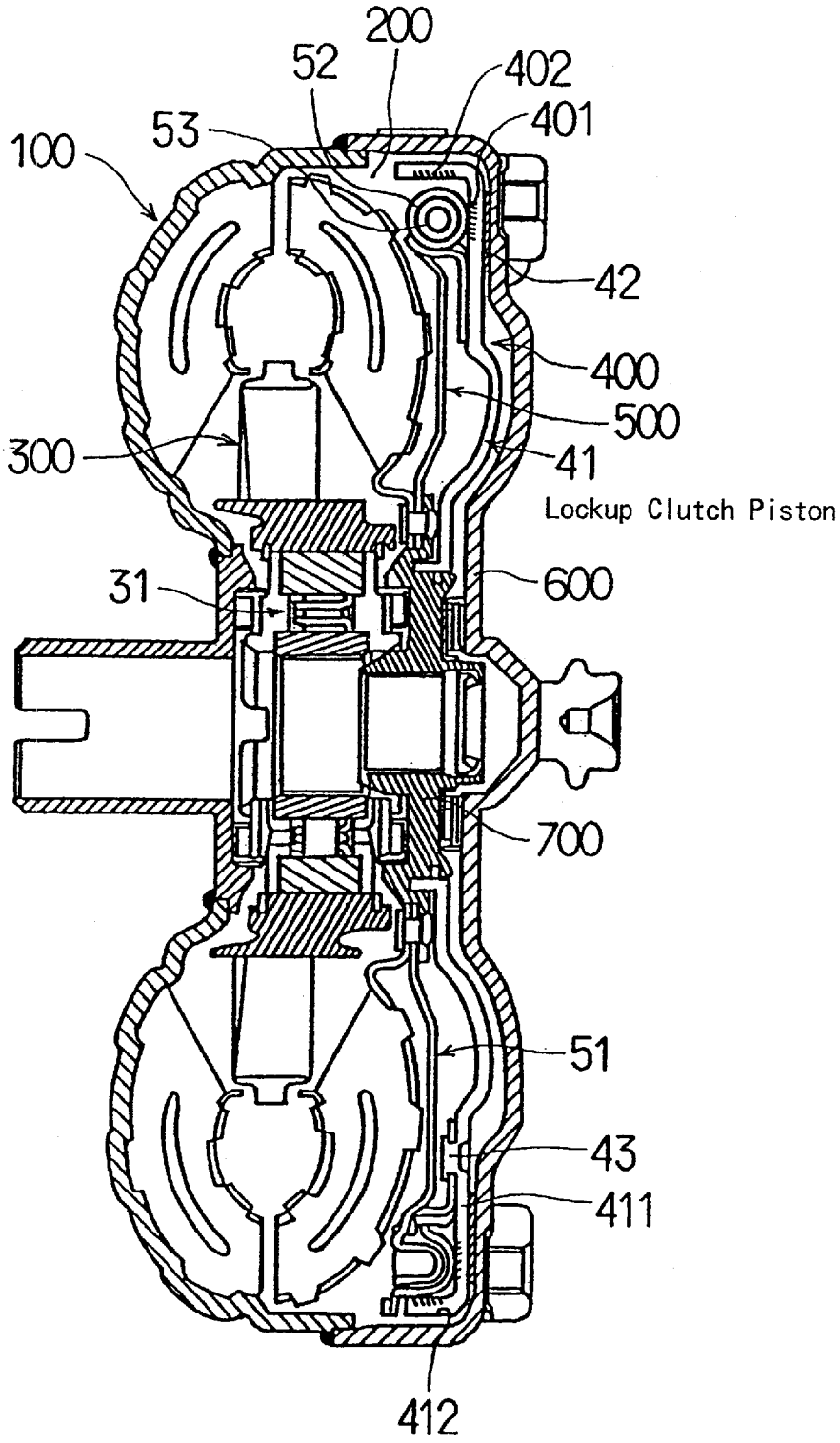
FIG. 5 is a cross-sectional view of a lockup clutch having a piston treated using the apparatus of the first or second embodiments.
Figure 6:
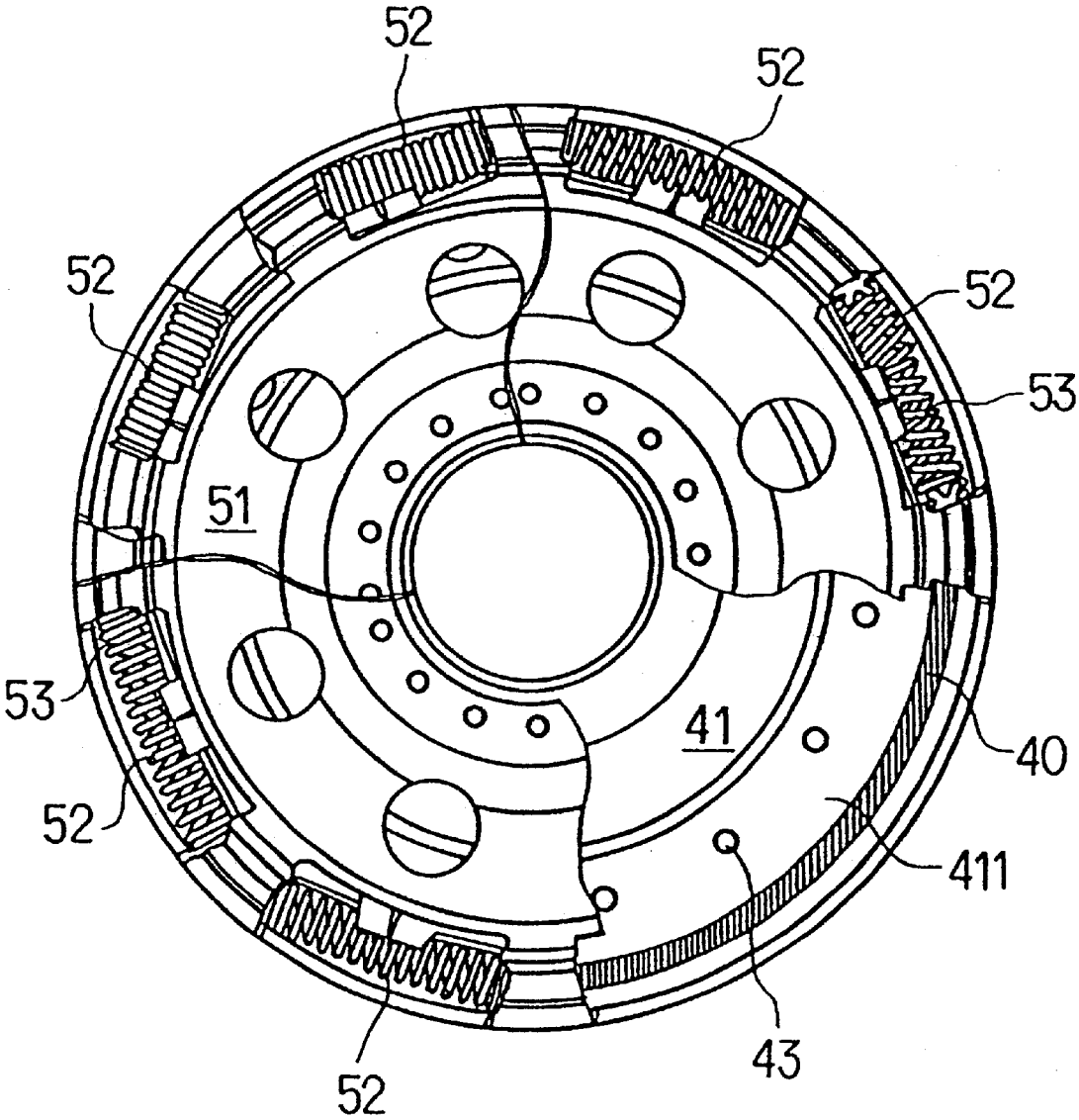
FIG. 6 is a plan view of the lockup clutch of FIG. 5.

A specific example of a steel member treated by the surface treatment method of embodiment 1 or 2 is a lockup clutch piston 41 of the torque converter as shown in FIGS. 5 and 6.

A torque converter is used in power transmission for a motor vehicle or the like. As shown in FIGS. 5 and 6, the torque converter comprises a pump impeller 100, a turbine runner 200 combined with the pump impeller 110 to form a torus, a stator 300, a lockup clutch 400 and a damper 500.

In this torque converter, rotation of an engine crank shaft is transmitted to a front cover 600, and to the pump impeller 100 fixed thereto. When the pump impeller 100 rotates, fluid inside the torus revolves around the shaft. The fluid is circulated between the pump impeller 100 and the turbine runner 200 and the stator 300.

By operation of the stator 300 (provided with a one-way clutch 31 attached on an inner peripheral side, allowing rotation only in a fixed direction) disposed between the pump impeller 100 and the turbine runner 200, the torque converter operates to amplify torque e.g. at the time of vehicle starting, where the pump impeller 100 has just started to rotate and, therefore, there is a large rotational speed difference between the pump impeller 100 and the turbine runner 200. After the rotational speed of the turbine runner 200 has increased so that the rotational speed difference between the turbine runner 200 and the pump impeller 100 becomes small, the torque converter operates merely as a fluid coupling.

The torque converter is provided with the lockup clutch 400 as mentioned above, to improve fuel economy. More specifically, when a pre-set vehicle speed is achieved after the vehicle has started, the lockup clutch piston 41 of the lockup clutch device 400 is operated by the switching of oil supply by a lockup relay valve (not shown in the drawings), and thereby moves in an axial direction, so as to engage the front cover 600 through a friction member 42. Thereby, rotation of the engine is transmitted to the input shaft of a speed changing mechanism without power transmission through the torque converter fluid, thereby improving fuel consumption.

The damper 500 disposed in the torque converter absorbs transmitted torque fluctuations that occur at the time of engagement and disengagement between the lockup clutch piston 41 and the front cover 600. The damper 500 is fixed to the lockup clutch piston 41 by flared pins 43. The damper 500 comprises a driven plate 51 rotatable together with the turbine runner 200, and springs 52, 53.

First stage springs 52 are disposed at eight spaced locations around the circumference of the lockup clutch piston 41. Second stage springs 53 are disposed at four locations around the circumference of the lockup clutch piston 41. The springs 53 are disposed within alternate springs 52, i.e. in every other location. The springs 53 have a smaller diameter and less length than the springs 52. The.springs 53 start to lengthen, (pull) after the torsional angle of the springs 52 reaches a set value and the transmitted torque reaches a set torque.

Rotation transmitted from the front cover 600 through the friction member 42. is further transmitted to turbine hub 700 by the damper device 500. During transmission of rotation, the springs 52, 53 compress to absorb transmitted torque fluctuations The damper 500 also serves to prevent vibrations, noise and the like caused by rapid fluctuations of the output torque of the engine transmitted to the speed changing device (not shown).

In the torque converter as described above, when the lockup clutch piston 41 is driven forward the lockup clutch piston 41 rotates counterclockwise in FIG. 6 with the lockup clutch device 400 being engaged and when the lockup clutch piston is driven backward the lockup clutch piston 41 rotates clockwise in FIG. 6, as in engine braking, the springs 52 expand and contract and, in doing so, repeatedly slide on a flat plate portion 411 of the lockup clutch piston 41. Therefore, the flat plate portion 411 of the lockup clutch piston 41 is subject to frictional wear caused by the sliding movement of the springs 52.

Furthermore, as the lockup clutch piston 41 rotates, the springs 52 receive centrifugal forces whereby the springs 52 are pressed against rim portion 412 of the lockup clutch piston 41. Thus, during forward and backward movement of the lockup clutch piston 41, the rim portion 412 of the lockup clutch piston 41 is also repeatedly subjected to sliding contact by the springs 52, thereby causing frictional wear.

Accordingly, in accordance with the present invention, the flat plate portion 411 and the rim portion 412 of the lockup clutch piston 41 are surface treated to improve their service in the environment as described above. The lockup clutch piston 41 is formed of a low carbon steel (S22C) that is easy to form.

Figure 7:
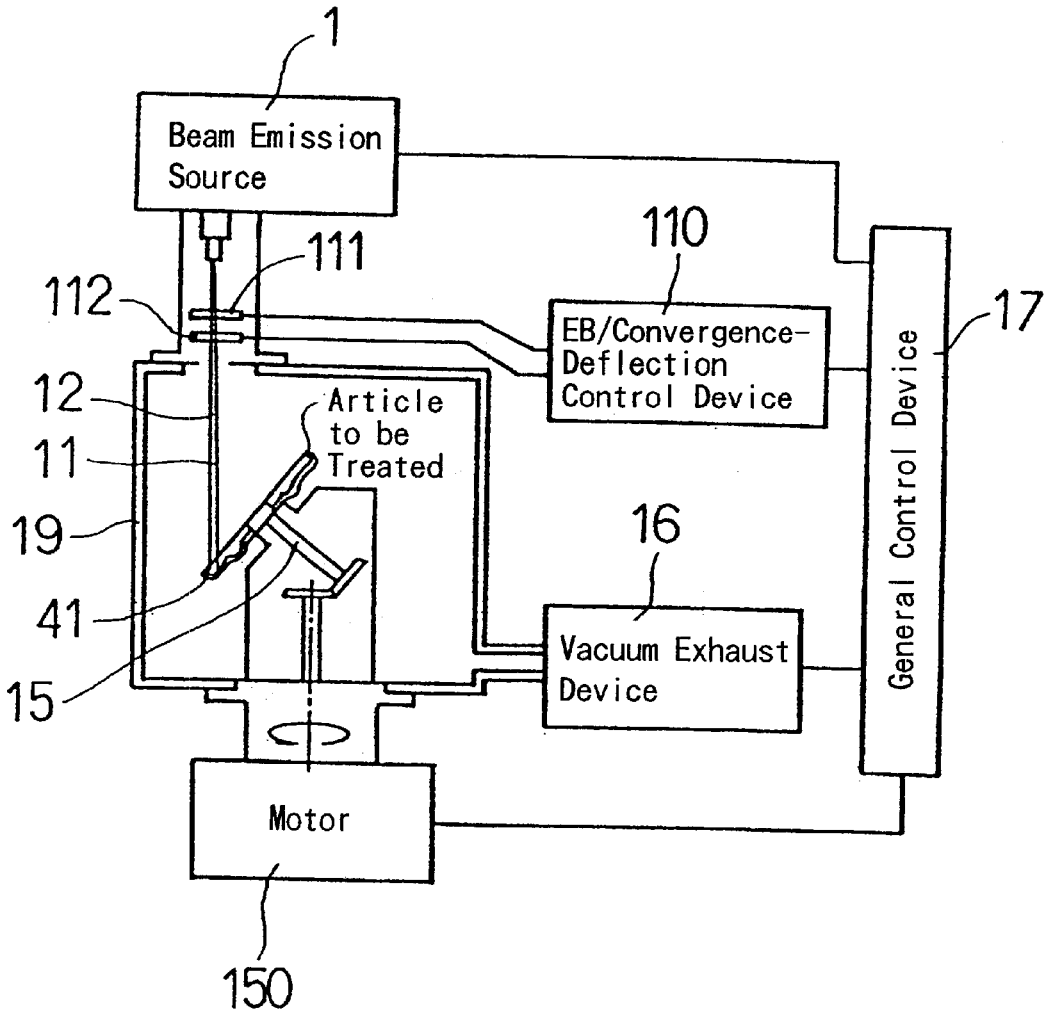
FIG. 7 is a block diagram of a third embodiment of a heat treatment apparatus in accordance with the present invention.

A third embodiment of the apparatus of the present invention is shown in FIG. 7 and has the same basic construction as the apparatus in Embodiment 2. The apparatus of this third embodiment is adapted for treatment of the above-described lock-up clutch piston and includes a placement table 15 which is tilted at 45°. A high density energy beam 10 from the beam emission source 1 is divided into two high density energy beams 11, 12 for irradiation as in Embodiment 2. Other apparatus components are the same as in Embodiment 2.

Using this apparatus, surface treatment is performed simultaneously on two surface portions 401 and 402, of the flat plate portion 411 and the rim portion 412 of the lockup clutch piston 41 as shown in FIGS. 8 and 9, to form hardened layers of 0.1–0.2 mm in thickness in the flat plate portion 411 and 3 mm in thickness in the rim portion 412.

More specifically, the lockup clutch piston 41 is set on the placement table 15 of the apparatus as shown in FIG. 7 and is rotated at a speed such that.the speed of the surface portions 401, 402 is about 16.7 m/minute. As shown in FIGS. 7 and 9, the surface portions 401, 402 are irradiated with the two high density energy beams 11, 12, for which electron beams of 4.6 KW output are used.

In. the two surface portions 401, 402, only a thin layer at the surface becomes melted. This melting occurs in a very short time and is followed by rapid cooling to form a martensitic structure, as indicated by the solid line E1 of FIG. 1.

The structure transformation will now be further described with reference to FIG. 10 which is an iron-carbon system equilibrium (phase) diagram wherein the abscissa represents carbon content and the ordinate represents temperature.

The surface-treated portions 401, 402 undergo transformation. as indicated by the dot-dash line $L_1$ in FIG. 10. That is, by electron beam irradiation, the normal temperature structure (ferrite-pearlite) is rapidly heated to become a melt L. Then, through self release of the heat, the melts solidify to become austenite, which immediately transforms. into a martensitic structure through further cooling by self release of heat.

FIG. 11 is a photograph of crystal grains in a section of a surface treated portion 401 in a lockup clutch piston 41 obtained as described above. The scale in FIG. 11 indicates distance from the surface of the member inward, i.e. 0 mm indicates the outer surface. As can be seen from FIG. 11, the surface-treated layer 401 comprises a completely melted layer 211 of about 0.03 mm in thickness extending inward from the exterior surface and an incompletely melted layer 212 of about 0.17 mm in thickness formed under layer 211, i.e. separated by layer 211 from the exterior surface.

FIG. 12 shows hardness distribution in a section of the surface-treated portion 401. In FIG. 12, the abscissa indicates distance from the surface of the member, and the ordinate indicates hardness (Hv). As can be seen from FIG. 12, a very thin hardened layer of about 0.2 mm or less was formed at the surface of the treated area 401. The same results were found in the surface treated area 402.

Thus, in the lockup clutch piston 41 treated in accordance with the present invention, the surface treated portions 401, 402 having excellent abrasion resistance are provided in areas of the flat plate portion 411 and the rim portion 412 which are in sliding contact with the springs. Therefore, if the lockup clutch piston 41 is incorporated into a torque converter, excellent durability will be attained.

Furthermore, since the portions of the piston other than the surface-treated portions 401, 402 have the same ferrite-pearlite structure as before the surface treatment, various forming/shaping processes utilizing plastic deformation or the like can be easily performed.

Further, since the surface hardened layer has a very small thickness and since the effect of the high density energy beams 11, 12 does not reach portions other than the surface treated portions,the circumferential configuration of the lockup clutch piston 41 is maintained with high precision. Therefore, it is possible to incorporate the heat-treated lockup clutch piston 41 into a torque converter without a separate, additional step for removing thermal strain, thereby enabling a production cost reduction.

In the case of the conventional electron beam quenching process (solid line C1 in FIG. 1), if it is applied to a lockup clutch piston 41, the heat capacity of the entire member needs to be at least eight times as large as that of the surface-treated portions. Therefore, it is necessary to use a plate having increased wall thickness for the lockup clutch piston 41. On the other hand, with the present invention, since the surface-treated portions 401 can be made very thin as described above, it is possible to reduce the thickness of the plate portion of the lockup clutch piston 41, thereby allowing a further reduction in production cost in this respect.

Further, this invention is able to considerably reduce the processing time as shown in FIG. 1, compared with the case of conventional electron beam quenching. Moreover, the surface a portions 401 and 402 in two spaced, separate locations can be simultaneously treated. Therefore, a much higher productivity can be obtained than with the conventional art.

Since the two surface portions 401, 402 in this embodiment are treated in a very short time, they receive no thermal effect from each other.

An example of a locus of the electron beam irradiation in Embodiment 3 will now be described with reference to FIG. 13.

The electron beam is directed for irradiation following circular deflection loci $C_1$, $C_2$. In this case, the electron beam is directed as the circular deflection loci. $C_1$, $C_2$ to irradiate regions 25, 26, with the high density energy beams 11, 12. During this treatment the steel member undergoing treatment is continuously rotated about a central axis. Therefore, the electron beam locus impinging regions 25, 26 moves in the direction indicated by an arrow H.

The circular deflection loci $C_1$, $C_2$ are formed by producing deflection sine waves in the directions of the x axis and the y axis and combining their deflections. Furthermore, in order to switch between the circular deflection loci $C_1$, $C_2$ and alternately irradiate the heat treatment regions 25, 26 with an electron beam, a deflection waveform $w_1$, as shown in FIG. 14 is generated, and the deflection waveform $w_1$, and the deflection waveform in the direction of the y axis are superimposed.

Therefore, during a time $t_1$, when the voltage $V_E$ is positive, the heat treatment region 25 is irradiated with an electron beam, and during a time $t_2$ when the voltage $V_E$ is a negative value, the heat treatment region 26 is irradiated with an electron beam.

Further, by setting a.reduced time $t_1$ and setting an increased time $t_2$ for the deflection waveform $w_1$, the irradiation energy impinging on the heat-treated areas 25, 26 can be adjusted.

For example, the flat plate portion 411 of the lockup clutch piston 41 does not.need to have as high an abrasion resistance as does the rim portion 412. Therefore, by setting a reduced time $t_1$, and an increased time $t_2$ for the deflection waveform $w_1$, it is possible to make the surface portion 401 softer than the surface portion 402, thereby enabling a reduction of the energy consumed in surface treatment and, moreover, allowing a further reduction of the processing time.

Another example of irradiation of regions 27, 28 with an electron beam is shown in FIG. 15. In this case, an electron be beam is directed for irradiation as two planar deflection loci $C_3$, $C_4$. That is, the electron beam is applied as the planar deflection loci $C_3$, $C_4$ to irradiate the areas 27, 28. During that time, the steel member under treatment is continuously rotated about a central axis. Therefore, the electron beam locus in the heat-treated regions 27, 28 also moves in the direction indicated by arrow H.

The planar deflection loci $C_3$, $C_4$ are formed by producing a deflection voltage of triangular waveform in the direction of the x axis and in the direction of the y axis. Furthermore, in order to switch between the planar deflection loci $C_3$, $C_4$ and irradiate the heat treatment regions 27, 28 with an electron beam, a deflection waveform $w_1$, is generated as shown in FIG. 16 and the triangular waves in the direction of the x axis and in the direction of the y axis are superimposed.

It is also possible to combine circular deflection and planar deflection, and to deflect an electron beam so as to follow the locus of a line, an ellipse or the like.

While in the above embodiments treatment of a lockup clutch piston of a torque converter has been described, the present invention may be applied to any steel member in need of complete or partial hardening of a surface portion, for example, plate areas which are frictionally engaged in multi-plate friction engagement devices, connectors, snap rings, oil pump plates, seal ring grooves, and the like.

Prevention of surface waviness in re-solidification of a melted surface portion, formed by the surface treatment method according to Embodiment 1, will now be described. Since the present invention temporarily melts a surface portion, the state of the surface during re-solidification of the melted portion becomes critical to quality. Therefore, the correlation between melt depth and waviness formed by re-solidification was investigated from various aspects.

First the processing speed (relative speed between the high density energy beam and the steel member under treatment) was serially varied while the width of the surface-treated areas (melt width) was held constant, in order to determine a critical melt depth that produces surface waviness, at each processing speed. Results of the tests are shown in the graph of FIG. 17.

In the graph of FIG. 17, the abscissa indicates the processing speed (m/min.), and the ordinate indicates the melt depth ($\mu$m), and the melt depths where surface waviness was produced are indicated by a solid line E61. The region below the solid line E61 is a region where no waviness occurs. As indicated by the graph, it can be seen that as the processing speed increases, melt depth causing no waviness becomes more shallow, if only the processing speed is considered.

Next, the width of the melt (surface treated portion) was serially varied while the processing speed was fixed, in order to measure a critical melt depth which produces surface waviness, for each melt width. Results of the tests are shown in the graph of FIG. 18.

In the graph of FIG. 18, the abscissa indicates the melt width (mm), and the ordinate indicates the melt depth ($\mu$m), and the melt depths that produced surface waviness are indicated by a solid line E62. The region below the solid line E62 is a region where no waviness occurs. As indicated by the graph, it can be seen that as the melt width increases, the limit of melt depth causing no waviness increases, if only the width is considered.

Thus, melt depth affects occurrence of surface waviness in two respects, that is, in accordance with the processing speed and the melt width. The foregoing tests demonstrate that when processing speed is increased, surface waviness can be reduced by reducing the melt depth, and when the processing speed is reduced, the hardened layer can be increased in thickness by increasing the melt depth.

Further, the foregoing tests demonstrate that where the surface-treated area width is reduced, the surface waviness can be reduced by reducing the melt depth and, where the surface-treated area width is increased, the hardened layer can be increased in thickness by increasing the melt depth.

Therefore, by referring to the results reported above, it becomes possible to.ensure an excellent finished treated surface free from waviness and, therefore, to ensure a high precision product.

As described above, the present invention, provides a steel member surface treatment method wherein the thermal strain and quenching failure are low even if the member treated is a thin plate component and further provides a high production efficiency.

While the present invention has been described with reference to what are presently considered to be preferred embodiments thereof, it is to be understood that the invention is not limited to these disclosed embodiments. On the contrary, the invention is intended to include various modifications and equivalent arrangements within the spirit and scope of the appended claims.

What is claimed is:

1. A steel member surface treatment method comprising:

heating, within a time period of not more than 0.2 sec., only a portion of a surface of a steel member of a given thickness to a temperature of at least its melting point so as to form a treated surface layer including a melt, said treated surface layer having a layer thickness less than said given thickness, by impinging the surface portion with a high density energy beam irradiation, wherein said heating is by a single pass of the beam over the portion surface; and immediately upon reaching said temperature, rapidly cooling the melt to within a martensitic transformation region of said steel member so as to form a martensitic structure.

2. A steel member surface treatment method according to claim 1, wherein said heating increases the temperature of the surface portion of the steel material at least 7500° C./second.

3. A steel member surface treatment method according to claim 2, wherein the melt is cooled to said martensitic transformation region at a rate of at least 600° C./second.

4. A steel member surface treatment method according to claim 1, wherein the melt is cooled to said martensitic transformation region at a rate of at least 600° C./second.

5. A steel member surface treatment method according to claim 1, wherein the member being treated is a thin plate steel member, and the melt has a depth such that waviness is not produced on the treated surface portion of the steel member.

6. A steel member surface treatment method according to claim 5, wherein the treated surface layer comprises a completely melted layer and an incompletely melted layer contiguous with the completed melted layer.

7. A steel member surface treatment method according to claim 1, wherein the high density energy beam is emitted from a single source of beam emission and is divided to irradiate a plurality of separated surface portions on the surface of the steel member.

8. A steel member surface treatment method according to claim 1, wherein the melt is allowed to spontaneously cool.

9. A steel member surface treatment method according to claim 1, wherein steel member comprises at least one untreated portion and wherein said one untreated portion has a heat capacity which is at least four times as large as the heat capacity of the melt.

10. A steel member surface treatment method according to claim 1, wherein the steel member has a thickness at least four times the depth of the melt.

11. A steel member surface treatment method according to claim 1, wherein the treated surface layer comprises a completely melted layer and an incompletely melted layer contiguous with the completely melted layer.

12. A steel member surface treatment method according to claim 11 wherein said treated surface layer has a depth of 0.2 mm or less.

13. A steel member surface treatment method according to claim 1, wherein said treated surface layer has a depth of 0.2 mm or less.

14. A steel member surface treatment method according to claim 1, wherein the time between start of the high density energy beam irradiation and formation of the melt is in the range of 0.003–0.2 seconds.

15. A steel member surface treatment method according to claim 14 wherein the melt is cooled to said martensitic transformation region at a rate within the range of 600–1800° C./second.

16. A steel member surface treatment method according to claim 1, wherein the melt is cooled to said martensitic transformation region at a rate within the range of 600–1800° C./second.

17. A steel member surface treatment method according to claim 1, wherein said heating within the single pass starts with the surface portion at a temperature within the martensitic transformation region.

18. A steel member surface treatment method according to claim 1, wherein said high density energy beam is an electron beam.

19. A steel member surface treatment method according to claim 18, wherein said electron beam is deflected to irradiate the surface portion with a shaped deflection locus.

20. A steel member surface treatment method according to claim 19 wherein said shaped deflection locus is a circular deflection locus or a planar deflection locus.

* * * * *

UNITED STATES PATENT AND TRADEMARK OFFICE

CERTIFICATE OF CORRECTION

PATENT NO. : 6,379,479 B1
DATED : April 30, 2002
INVENTOR(S) : Ohbayashi et al.

It is certified that error appears in the above-identified patent and that said Letters Patent is hereby corrected as shown below:

Column 1,
Line 15, “Invention” should read -- invention --
Line 50, “austeriitic” should read -- austenitic --
Line 53, “temperatures” should read -- temperature. --

Column 3,
Line 42, “preferable.that” should read -- preferable that --
Line 48, “preferred:that “ should read -- preferred that --

Column 4,
Line 25, “b 1/4” should read -- 1/4 --

Column 6,
Line 56, “Fig.” should read -- (Fig. --

Column 8,
Line 23, “fluctuations” should read -- fluctuations. --

Column 9,
Line 8, “In.the” should read -- In the --

Column 12,
Line 50, “completed” should read -- completely --

Signed and Sealed this

Twenty-third Day of July, 2002

*Attest:*

*Attesting Officer*

JAMES E. ROGAN
*Director of the United States Patent and Trademark Office*